US005899432A

United States Patent [19]

Petrovich et al.

[11] Patent Number: 5,899,432

[45] Date of Patent: May 4, 1999

[54] ADJUSTABLE TEST STAND FOR BALLISTIC SAMPLE TESTING

[75] Inventors: Paul A. Petrovich, Livingston County; Richard J. Line, Macomb County, both of Mich.

[73] Assignee: The United States of America as represented by the Secretary of the Army, Washington, D.C.

[21] Appl. No.: 08/967,299

[22] Filed: Aug. 28, 1997

[51] Int. Cl.[6] ..... F16M 1/00

[52] U.S. Cl. ..... 248/676; 273/371

[58] Field of Search ..... 248/158, 161, 248/405, 411, 415, 448, 157, 419, 420, 163.1, 163.2, 544, 676, 672, 625; 273/371; 73/12.11, 12.01, 167

[56] References Cited

U.S. PATENT DOCUMENTS

| | | | |
|---|---|---|---|
| 2,526,018 | 10/1950 | Foster et al. | 124/73 |
| 3,142,980 | 8/1964 | Anderson | 73/834 |
| 3,380,290 | 4/1968 | Michelson | 73/12.01 |
| 3,915,143 | 10/1975 | Waller | 124/11 R |
| 4,349,200 | 9/1982 | Wakefield | 273/371 |
| 4,511,112 | 4/1985 | Ruehle | 248/544 |
| 4,932,628 | 6/1990 | Pacheco | 248/676 |
| 5,163,642 | 11/1992 | Torrens et al. | 248/49 |
| 5,396,791 | 3/1995 | Mollmann et al. | 73/116 |
| 5,775,699 | 7/1998 | Oritto et al. | 273/371 |

*Primary Examiner*—Leslie A. Braun
*Assistant Examiner*—Tan Le
*Attorney, Agent, or Firm*—Peter A. Taucher; David L. Kuhn

[57] ABSTRACT

An adjustable test stand for holding ballistic samples during testing, the test stand having trusses carrying specimen holding members the trusses having curved arms which cooperate with the specimen holders to hold the specimens at various angles of incidence relative to the vertical to allow testing over a variety of incident angles.

1 Claim, 2 Drawing Sheets

Fig. 3
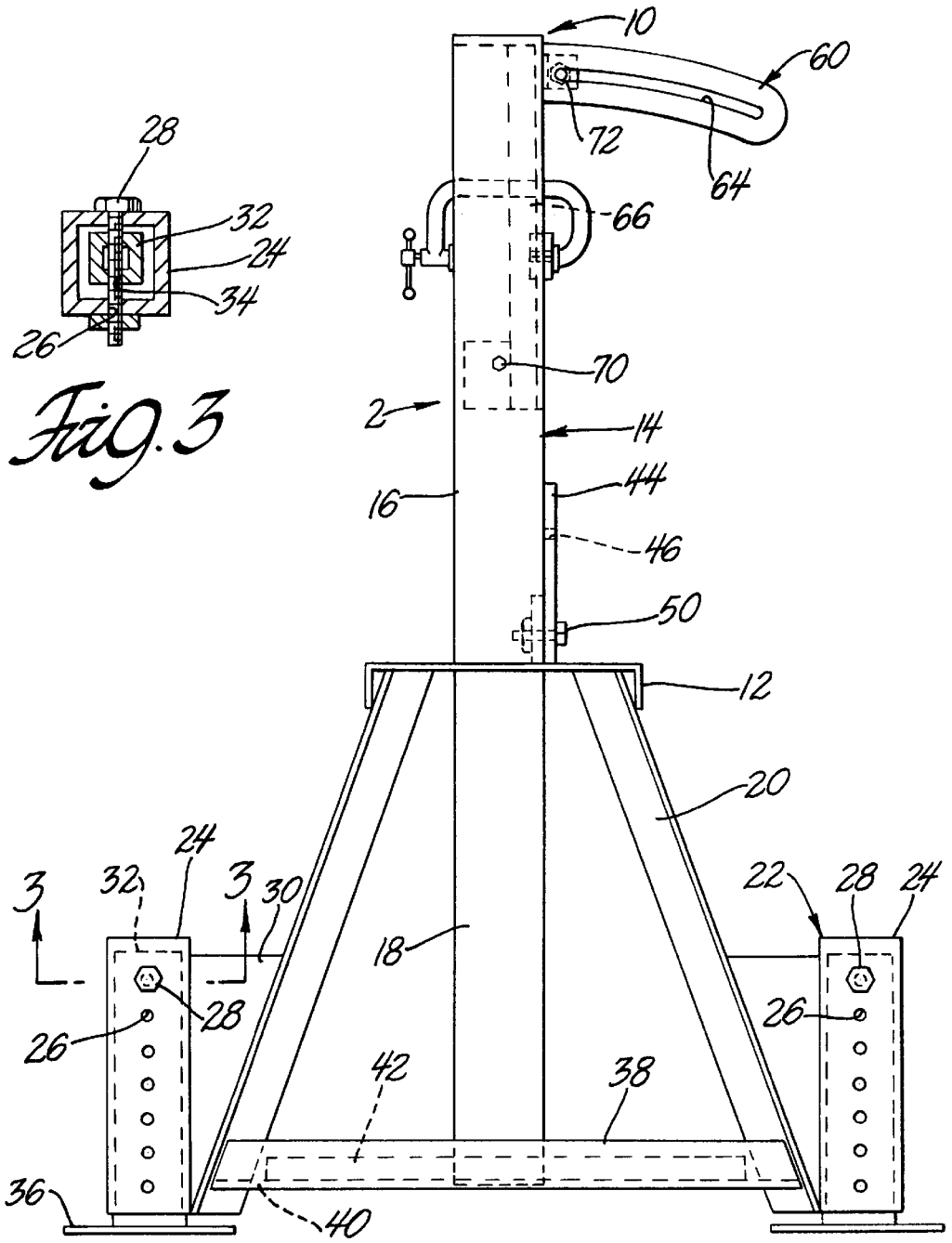
Fig. 2
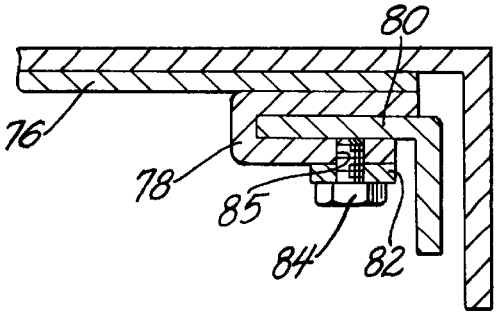
Fig. 4

ADJUSTABLE TEST STAND FOR BALLISTIC SAMPLE TESTING

GOVERNMENT INTEREST

The invention described here may be made, used and licensed by for governmental purposes without paying us any royalty.

BACKGROUND OF THE INVENTION

1. Field of the Invention

In one aspect this invention relates to test stands for holding samples to be subjected to testing. In a further aspect this invention relates to the testing of ballistic materials.

2. Prior Art

In general ballistic samples are clamped in a fixed frame and the desired projectile fired at the sample. For many samples, it is desired to test samples where the projectile path has a variety of different angles of incidence which requires the sample to be firmly held at various angles to the vertical when being tested.

SUMMARY OF THE INVENTION

Briefly the present invention relates to an adjustable support stand for positioning a piece of ballistic material for ballistic testing at various angles. The stand has a base ember to which various items are attached to hold, support and maintain the ballistic sample in the desired position.

A pair of complimentary truss members are associated with the base member, with one truss being located on each side of the base member. This palaces the trusses in an opposing relationship. Each truss has an upper portion which extends orthoganally upward from the uppermost surface of the base and a second lower portion which extends below the base's lower surface.

A plurality of supporting legs are attached to the lower surface of the base member. The legs are attached so they extending outward from the lower surface of the base member at an angle to provide a broadened base for supporting the base member.

Each leg has a complimentary adjustable foot attached to the end of the leg opposite the base member which allows the legs to be independently adjusted for length. This allows the test stand to be used on uneven surfaces, and also, the base orientation can be changed so as to change the angle of the trusses as will be described later.

The test stand of this invention has a pair of cross members, one cross member being attached to the lower portion of each truss, the cross members being firmly attached to the associated truss and the nearby associated legs to form a rigid brace structure for the lower portion of the test stand.

A complimentary retention bracket is associated with each truss. These brackets extend orthoganally both to an associated truss and the upper surface of the base member and are rigidly attached to the associated truss and base upper surface to provide stability. The retention brackets have an elongated aperture formed in their bodies, the elongated aperture having its longitudinal axis orthoganally disposed to the base member.

A vertically adjustable retention bar is disposed between the retention brackets. Each end of the retention bar has a pin extending through the elongated aperture in the associated bracket with the pin having an associated fastening means. The pins can be moved vertically within the elongated aperture and the fastening means tightened to firmly hold the retention bar at the desired location relative to the base member.

Each truss also has an associated curved arm with one end firmly attached to the upper portion of the associated truss. The curved arms have a curved aperture formed along a substantial portion of the arm and extend away from their associated trusses arcing downwards towards the base member.

Each truss has a rotatable arm attached; the rotatable arm has one end rotatably mounted to the upper portion of the truss at a location midway between the base member and the trusses upper end. The other, free end, opposite the point at which the arm is joined to its associated truss has a projection which extends orthoganally towards the curved arm and engages the curved aperture. There are tightening means associated with the projection to firmly lock the free end of the rotatable arm to the curved arm.

An upper frame member is disposed between and attached to the free ends of the rotatable arms to form the upper holding member for ballistic samples.

a plurality of clamping means are associated with the upper frame member, so a ballistic target can be held in position on the frame.

BRIEF DESCRIPTION OF THE DRAWING

In the accompanying drawing:

FIG. 2 is a front view of the invention of FIG. 1;

FIG. 3 is a partial view in section taken along the line 3—3 of FIG. 1; and FIG. 4 is a partial view in section taken along the line 4—4 of FIG. 2.

DETAILED DESCRIPTION

Figure 1:
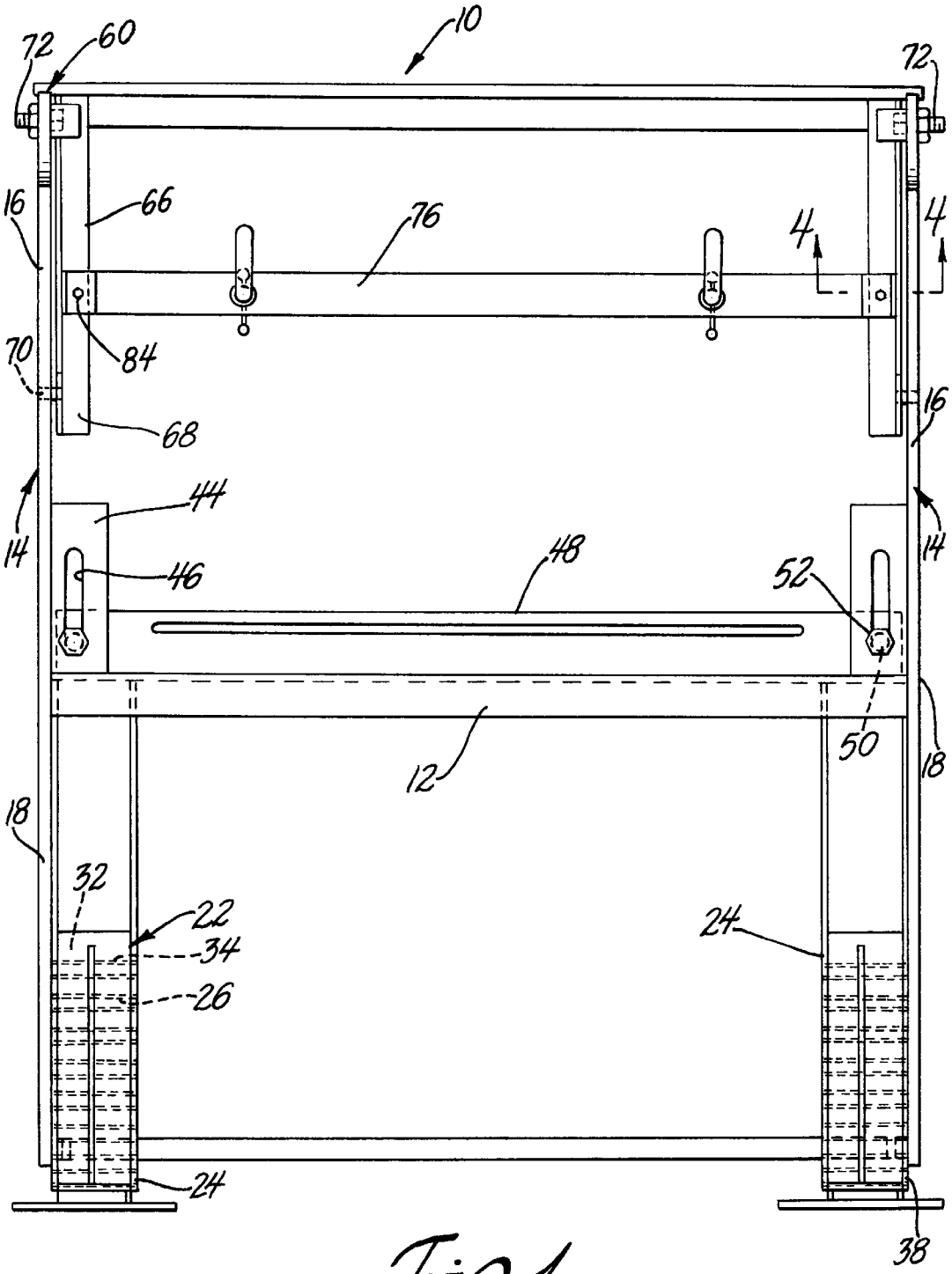
FIG. 1 is a side view of one embodiment of this invention.

Referring to the accompanying drawing in which like numerals refer to like parts and initially to FIGS. 1 and 2, one example of an adjustable support stand for testing ballistic materials at various angles is shown. The test stand designated generally 10 has base member 12 to which various components of the test stand are attached. The components, as described hereinafter hold, support and maintain a ballistic sample to be tested in desired orientation over a predetermined range of incident angles.

A pair of complimentary truss members 14 are attached to the base member 12 with one truss being located in opposing relationship on each side of the base member. Each truss 14 is disposed essentially vertically and has an upper portion 16 extending orthoganally upward from the uppermost surface of the base member 12 and a second lower portion 18 which extends downward below the base's lower surface.

A plurality of legs 20 are attached to the lower surface of the base member 12 extending downward from the lower surface of the base member at an angle to the base member to provide a broad base for supporting the test stand.

Each leg 20 has a complimentary adjustable foot designated generally 22 attached to the end of the leg opposite the base member 12. The adjustable feet 22 allow the legs 20 to be independently adjusted as to length which allows the base to be placed on unlevel surfaces. Also, the base member's 12 orientation can be changed from its nominal horizontal orientation so as to change the angle of the trusses 14 and any sample with respect to the vertical.

The adjustable feet 22 are shown in cross section in FIG. 3, the feet having an outer housing 24 having a plurality of apertures 26 placed along the longitudinal axis of the outer housing. There are complimentary apertures located on the opposite wall of the outer housing 24 to form a path for a pin 28 or similar fastener to extend from side to side through the outer housing. The outer housing 24 is shown attached to the terminus of its associated leg 20 by means of a triangular web 30. The web 30 is shown as a right triangle with the hypotenuse attached to the associated leg 20 and the outer housing 24 attached to one edge of the web 30 which is oriented essentially vertically with respect to the ground.

The second portion of each adjustable foot 22, comprises a post 32 which has a plurality of post apertures 34 disposed along the longitudinal axis of the post, the post apertures being complimentary to the housing apertures 26 in the housing 24 so fastener 28 can extend between complimentary housing apertures, through post apertures 34 to retain the post at the desired location within the housing. Each post 32 has a foot 36 attached to a ground engaging end to provide good grounding and stability. The feet 36 will be sized so as to provide good stability, such sizing being within the skill of the art and determined by the expected forces on the sample.

The stand of this invention has a pair of cross members 38 located near the base, one cross member being attached at its mid portion to the lower portion of an associated truss 18 and the ends of the cross members being firmly attached to the nearby associated legs 20 to help form a rigid lower structure. The cross members 38 are formed with a lip 40 which extends inward towards the other legs so as to form a ledge. The opposing lips 40 of the cross members 38 form a support for a removable plate 42 extending between the cross members. The removable plate 42 provides additional weight to the structure for stability but can be removed to facilitate moving the test stand 10 of adjusting the legs 22. Further, the removable plate allows additional weight to be placed on the plate to further increase stability. The removable feature allows the test stand 10 to be unloaded and easily moved yet weighted to the level required for safe testing when the test stand is in the desired position.

A pair of complimentary retention brackets 44 are attached to the upper surface of the base member 12 opposite the surface to which the legs 18 are attached. There is one bracket associated with each truss 14. The retention brackets 44 extend orthoganally both to the associated truss 14 and the upper surface of the base member 12 and are rigidly attached to their associated trusses and the upper surface of the base member to provide stability. The retention brackets 44 each have an elongated aperture 46 formed in the body of the bracket, the elongated aperture having its longitudinal axis orthoganally aligned with respect to the base member 12, the elongated aperture being used to help hold and position the lowermost portion of the target during testing.

A vertically adjustable retention bar 48 is disposed between the retention brackets 44. Each end of the retention bar 48 has a threaded pin 50 extending through the elongated aperture 46 of the associated retention bracket 44 with the threaded pin having an associated fastening means 52 such as a nut. The threaded pins 50 are moved vertically within the elongated aperture 46 and the fastening means 52 tightened to firmly hold the retention bar 48 at the desired location relative to the base member 12. Other fastening or clamping means could be used and are known in the art so further discussion will be omitted in the interest of brevity.

Each truss 14 has an associated curved arm 60 with a first end 62 firmly attached to the upper portion of the associated truss. Each curved arm 60 extends away from its associated truss and arcs downwards towards the base member 12 at its free end. The curved arms 60 have a curved channel 64 formed along a substantial portion of the curved arm.

Each truss 14 has a rotatable arm 66 with a first fixed end 68 rotatably mounted at a location midway between the base plate 12 and the trusses upper end. As shown the rotatable arm 66 is positioned on a pintle 70 with one end of the pintle mounted on the truss and the other end of the pintle journaled in the rotatable arm. The other end of the rotatable arm 66 opposite the pintle has a threaded projection 72 which extends from the rotatable arm 66 towards the curved arm 60 and extends through the curved aperture 64 in an associated curved arm. There are tightening means 74 such as a hex nut in the present case which can be tightened to firmly lock the rotatable arm's end to the curved arm. The curved apertures arc is defined by the pintle and the threaded projection 72.

An upper frame member 76 is disposed between and attached to the rotatable arms to form an upper holding member for ballistic samples. The holding member 76 has a clamping means, shown in FIG. 4, which allows the upper frame member to be moved longitudinally along the rotatable arm 66. The attachment of the holding member 76 to the rotatable arm 66 is detailed in FIG. 4. The holding member 76 has a C-shaped bracket 78 enclosing one leg 80 of rotatable arm 66 shown as an L-shaped structure. The C-shaped bracket 78 is permanently attached to the upper member 76 such as by welding and has a threaded fastener 82 permanently attached. A threaded machine screw 84 engages the threaded fastener 82 with the screw body extending through an aperture 85 formed in the C-shaped bracket 78 and the point of the threaded fastener 84 firmly engages the leg 80 to hold the C-shaped bracket and the upper member 76 in position.

A plurality of clamping means will be used to hold the desired sample in position on the to the test fixture 10. For example, common C-clamps can be used to provide means to hold the test sample in position.

Various alterations and modifications will become apparent to those skilled in the art without departing from the scope and spirit of this invention and it is understood this invention is limited only by the following claims.

What is claimed is:

1. An adjustable support stand for positioning a piece of ballistic material for ballistic testing at various angles comprising;

a rectangular base member having an upper and lower surface;

a pair of complimentary truss members, the trusses being located on opposite sides of the base member in an opposing relationship, each truss having an upper portion extending orthoganally upward with respect to the upper surface of the base member, and a second portion extending below the base member's lower surface;

a plurality of legs attached to the lower surface of the base member, the legs extending outward from the base member at an angle to the surface of the base to provide a broadened base for supporting the base member;

a plurality of complimentary adjustable feet one foot being attached to the end of a leg at a point opposite the attachment to the base member;

a pair of cross members one cross member being attached to the lower portion of each truss and extending outward from the truss to a associated leg the cross member being attached to the leg;

a pair of complimentary brackets, one bracket being associated with each truss, the brackets extending orthoganally to the associated truss and the upper surface of the truss the bracket being rigidly attached to the truss and the upper surface of the base member, the bracket having a an elongated aperture formed therein, the elongated aperture having its longitudinal axis orthoganally disposed to the base member, a vertically adjustable retention bar disposed between the retention brackets, each end of the retention bar having a pin extending through the associated elongated aperture in the bracket, the pin having a tightening means associated therewith suitable to firmly hold the retention bar at the desired location relative to the base member;

a curved arm having one end firmly attached to the end of the trusses upper portion distal the base member, the curved arm having a curved aperture formed therethrough, the curved arm extending away from and down from the end of the truss distal the base;

a rotatable arm having one end rotatably mounted to the upper portion of the truss at a location midway between the base plate and the trusses end distal the plate, the rotatable arm having a projection engaging the curved aperture in the associated curved arm, an upper frame member disposed between the rotatable arms and having its ends attached to the rotatable arms, a plurality of clamping means attached to the upper frame member, the clamping means being adapted to hold a ballistic target in position on the frame, whereby a target to be tested can be clamped on the upper frame member, and the upper frame member moved on an arcuate path to change the angle of presentation of the target surface, and the vertically adjustable retention bar moved into contact with the bottom of the target to firmly hold the target in position.

* * * * *